US006152200A

United States Patent [19]

Smothers

[11] Patent Number: 6,152,200

[45] Date of Patent: Nov. 28, 2000

[54] MACHINE FOR MAKING WOOD SHAVINGS FOR ANIMAL LITTER

[76] Inventor: Gerald Smothers, 3804 Weaver Ct., Anoka, Minn. 55303

[21] Appl. No.: 09/483,235

[22] Filed: Jan. 14, 2000

[51] Int. Cl.[7] ..... B27C 1/00

[52] U.S. Cl. ..... 144/180; 144/154; 144/162.1; 144/185; 144/188; 144/221; 241/151; 241/280

[58] Field of Search ..... 144/162.1, 176, 144/180, 182, 185, 188, 154, 373, 29, 218, 221; 241/34, 42, 136, 151, 152.1, 279, 280

[56] References Cited

U.S. PATENT DOCUMENTS

| | | | |
|---|---|---|---|
| 259,868 | 6/1882 | Kane . | |
| 683,199 | 9/1901 | Dekin | 144/188 |
| 901,969 | 10/1908 | Hoover . | |
| 1,795,064 | 3/1931 | Wiener | 144/185 |
| 1,883,876 | 10/1932 | Brown . | |
| 1,979,373 | 11/1934 | Ellis . | |
| 1,987,946 | 1/1935 | Shaw et al. . | |
| 2,776,685 | 1/1957 | D'A Clark . | |
| 2,840,127 | 6/1958 | Stokes et al. . | |
| 3,155,130 | 11/1964 | Logan et al. . | |
| 4,074,737 | 2/1978 | Stewart . | |
| 4,131,146 | 12/1978 | Koch . | |
| 4,148,345 | 4/1979 | Rogers | 144/162.1 |
| 4,253,506 | 3/1981 | Shimohira . | |
| 4,289,178 | 9/1981 | Rogers | 144/188 |
| 4,350,191 | 9/1982 | Riedl . | |
| 4,936,361 | 6/1990 | Mercier et al. . | |
| 4,964,447 | 10/1990 | Farrell et al. | 144/162.1 |
| 5,829,500 | 11/1998 | Van Elten | 144/185 |

*Primary Examiner*—W. Donald Bray
*Attorney, Agent, or Firm*—Haugen Law Firm PLLP

[57] ABSTRACT

Apparatus for creating wooden shavings for stock bedding from logs which includes a frame supporting a carriage bed and rotary carriage ring. Arcuately spaced rotary cutter means are provided on the carriage bed, and are positioned to contact logs supported on the carriage ring. The carriage ring consists of an annular carriage support ring which supports arcuately spaced log-receiving boxes, so that upon rotation of the annular carriage support ring, logs positioned within the log-receiving boxes are exposed to the cutting action of the rotary cutter means.

8 Claims, 7 Drawing Sheets

MACHINE FOR MAKING WOOD SHAVINGS FOR ANIMAL LITTER

BACKGROUND OF THE INVENTION

The present invention relates generally to an improved apparatus for the creation of wood shavings for livestock litter, in particular poultry litter, as well as certain other domestic and/or fur-bearing animals maintained in a controlled environment or enclosure, wherein the shavings are shaved to a desirably large size, and are delivered centrally within the core of the annularly configured apparatus. Wood shavings have long been used for bedding poultry, particularly turkeys and chickens. The shavings provide an absorbent mechanism for waste and droppings, and hence provides a more hospitable environment for the birds. The shavings are changed at desirable intervals, and may be disposed of in an environmentally friendly fashion.

It has long been recognized that large size shavings are preferred over smaller shavings and/or sawdust. The large shavings, normally formed in a curled configuration, are both stock-friendly and environmentally friendly. As such, shavings of this type are preferred.

In the creation of shavings from logs and the like, rotary knives have frequently been employed and certain blade and/or knife designs create high levels of noise. This is particularly true when frozen logs are being treated. In accordance with the present invention, however, large size wood shavings are created in a low-noise environment, with the low noise level being consistently created even when frozen logs and/or workpieces are used as the source.

SUMMARY OF THE INVENTION

In accordance with the present invention, an apparatus for shaving the surfaces of wooden logs is provided for the production of wood shavings. The apparatus comprises a frame upon which a carriage bed is mounted together with a rotatable carriage ring positioned in superimposed relationship to the bed. Rotary cutter means are mounted on the carriage bed. The rotary cutting means are cylindrical structures with helically arranged cutter blades secured to the surface of the cylinder. A plurality of rotary cutters are arranged in equally arcuately spaced relationship on the bed. The carriage ring means includes a generally annular carriage support ring superimposed upon the bed, with the carriage ring having spaced apart log-receiving boxes formed thereon. The boxes are designed to receive logs which then slide across the surface of the bed and the rotary cutter heads then make contact with the log surfaces as they pass over the rotary cutters. Suitable drive means are provided to rotate the annular carriage support in a continuous fashion, at a rate which is matched to the rotational velocity of the rotary cutters so as to provide wood shavings of desirable configuration and size. In order to reduce the effort required in gathering the shavings, the rotary cutters are designed to rotate in the direction for discharge of the shavings or chips radially inwardly of the apparatus. From the inner core of the annular assembly, an auger or other suitable gathering means may be utilized to transfer the shavings to a suitable delivery station.

Therefore, it is a primary object of the present invention to provide an improved apparatus for creation of wood shavings wherein the individual shavings are of desirable configuration including, for example, multiple curl configurations of substantial width.

It is a further object of the present invention to provide an improved apparatus for preparation of wood shavings from logs wherein an articulated system including a carriage bed and rotatable carriage ring are employed in combination with a plurality of work stations equipped with rotary cutters with helically arranged cutter heads positioned on rotatable right regular cylinders.

Other and further objects of the present invention will become apparent to those skilled in the art upon a study of the following specification, appended claims, and accompanying drawings.

IN THE DRAWINGS

Figure 11:
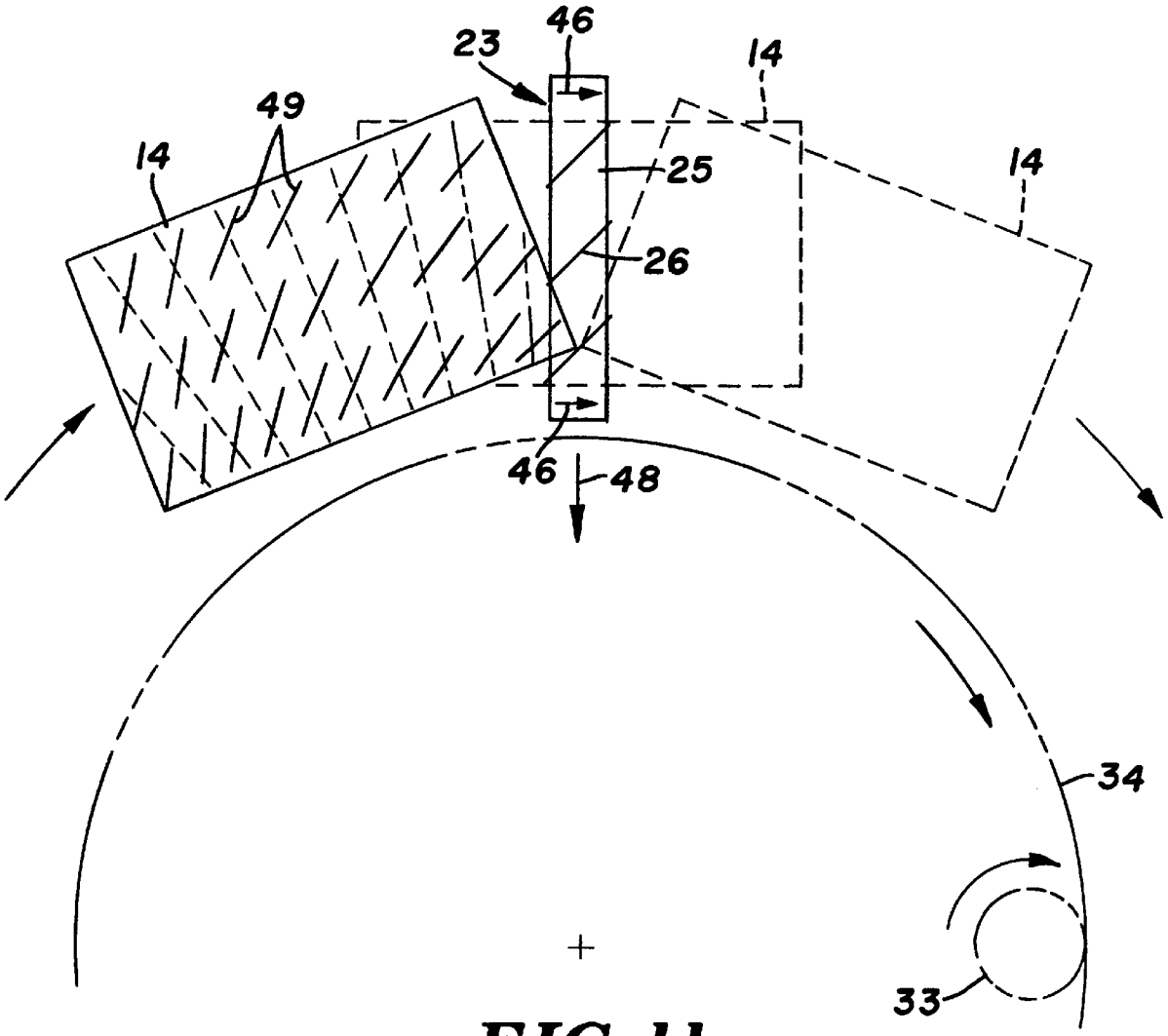
Figure 10:
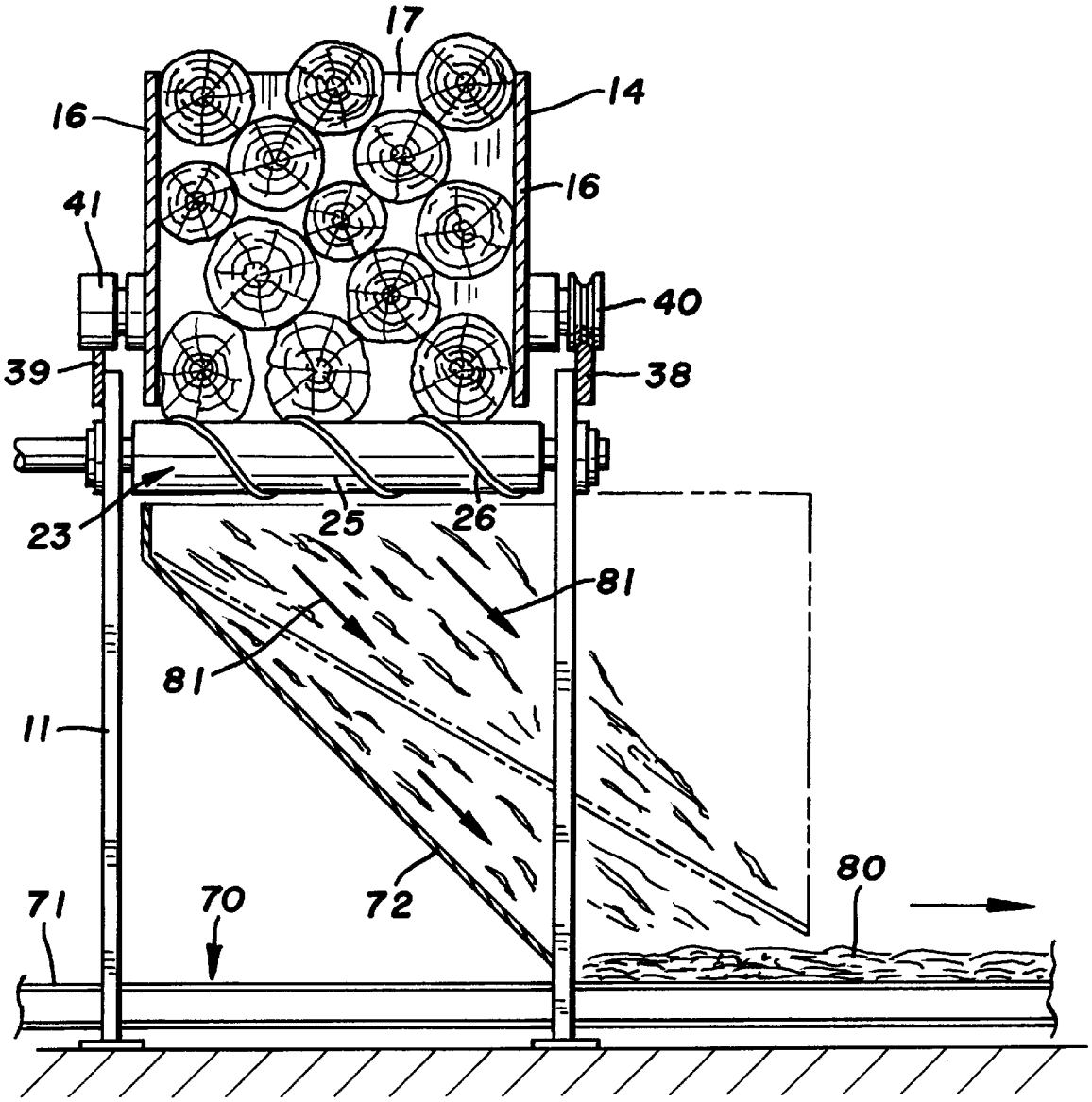

FIG. 10 is a detail fragmentary view, on an enlarged scale, of one of the cutter stations illustrating the disposition of two typical alternative chute angles for delivering wood shaving product onto the surface of the conveyor belt, with one of the two alternative chute angles being shown in phantom; and FIG. 11 is a fragmentary top plan view illustrating the motion and advance of the carriage ring means relative to the carriage bed, and illustrating the relationship of the rotary cutter means, the helical cutter heads, and the direction of shaving and/or chip discharge.

DESCRIPTION OF THE PREFERRED EMBODIMENT

Figure 1:
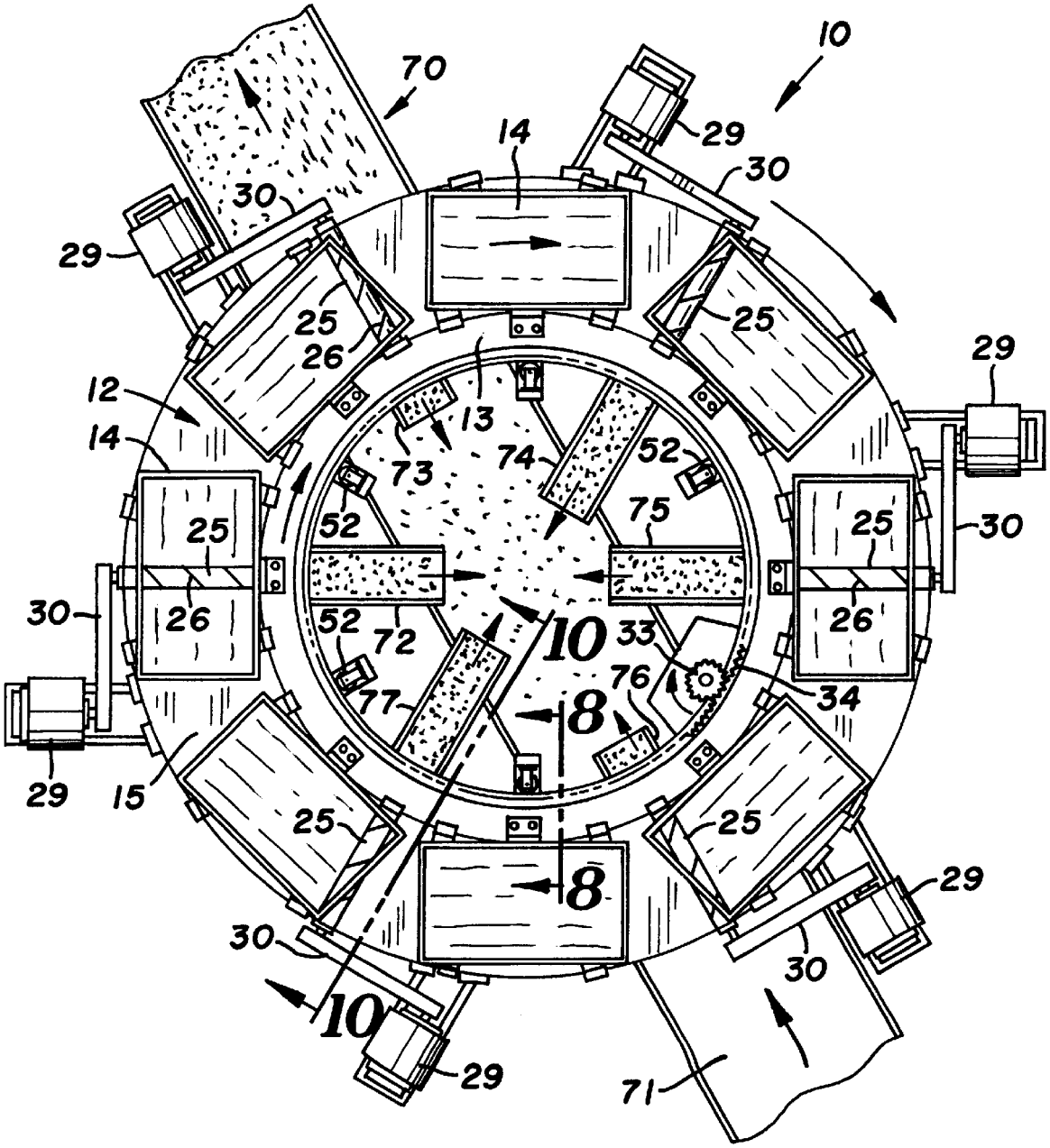
FIG. 1 is a top plan view of a preferred embodiment of the present invention and illustrating the arrangement of the carriage ring means in superimposed relationship to the carriage bed, with two of the rotary cutters being exposed, and with the wood shaving product conveyor being shown in partially broken-away form.
Figure 3:
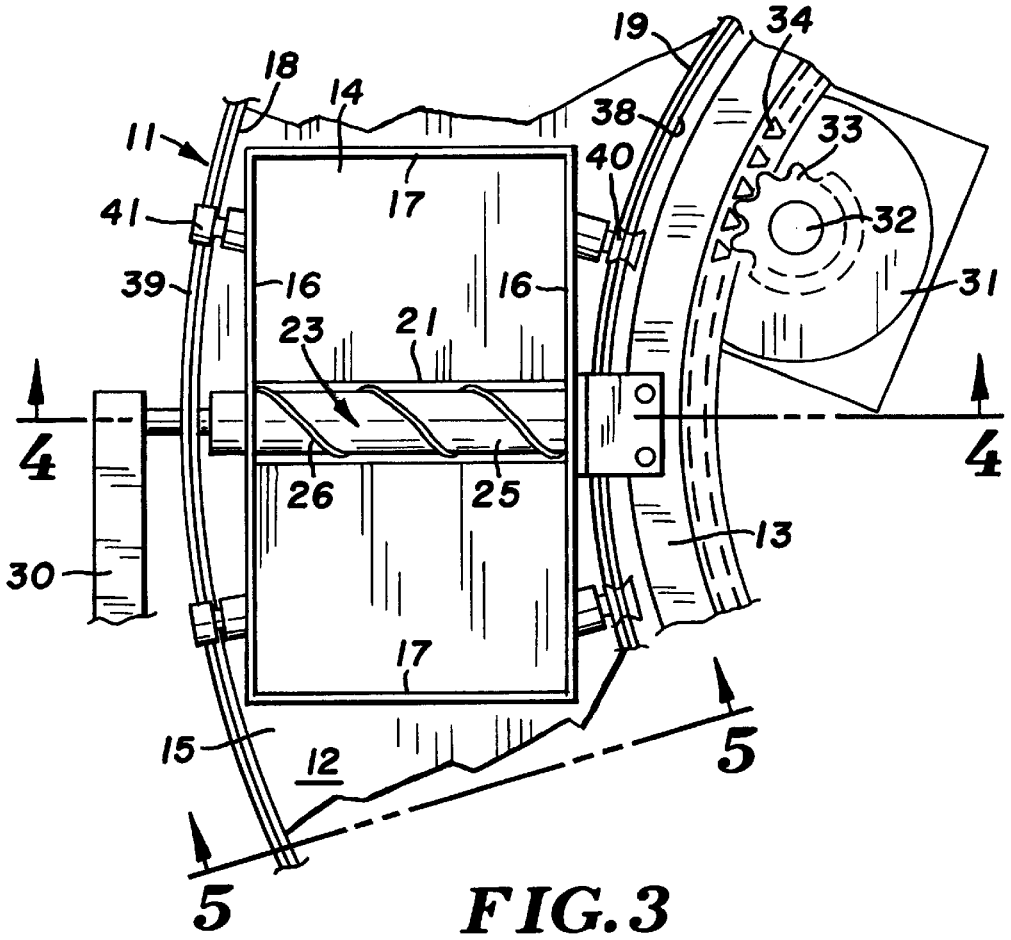
FIG. 3 is a fragmentary top plan view on an enlarged scale and illustrating one log carrying box, along with an accompanying rotary cutter and drive gear/pinion combination for rotation of the carriage ring relative to the carriage bed.

In accordance with the preferred embodiment of the present invention, the apparatus for shaving wooden log surfaces for the preparation of wood shavings generally designated 10 comprises a frame means 11 for support of a carriage bed generally designated 12. Frame 11 further is utilized for journaled support of carriage ring means generally designated 13 in the form of a generally annular carriage support ring having a plurality of arcuately spaced apart log-receiving boxes 14—14 formed therein. The annular carriage support ring is journaled for rotation about a central axis normal to the working surface 15 of carriage bed 12. As is indicated in FIGS. 1 and 3, log-receiving boxes 14 are provided with side walls as at 16—16 and end walls as at 17—17. As such, boxes 14—14 are provided with an open top and an open bottom.

Figure 5:
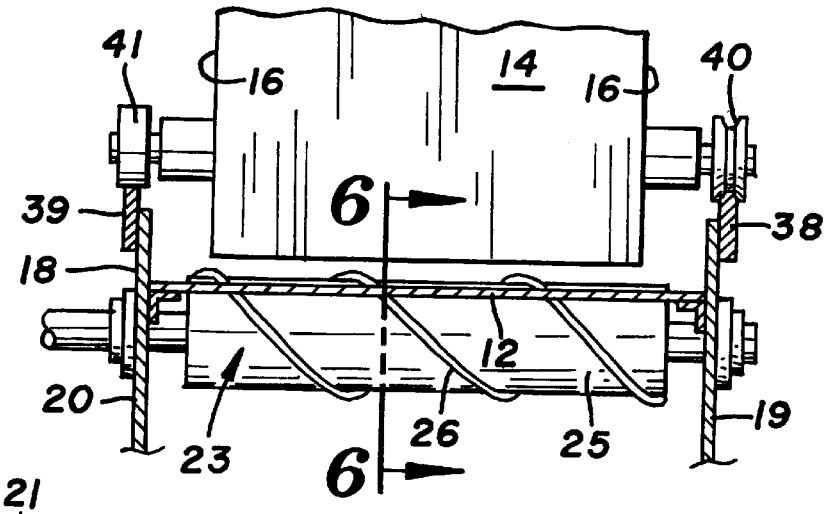
FIG. 5 is a vertical sectional view taken along the line and in the direction of the arrows 5—5 of FIG. 3.
Figure 6:
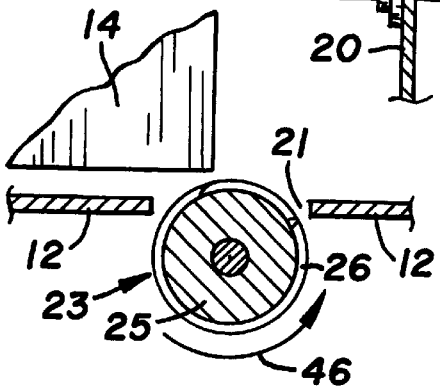
FIG. 6 is a vertical sectional view taken along the line and in the direction of the arrows 6—6 of FIG. 5 and illustrating the configuration and disposition of the rotary cutter means utilized in connection with the present invention.
Figure 7:
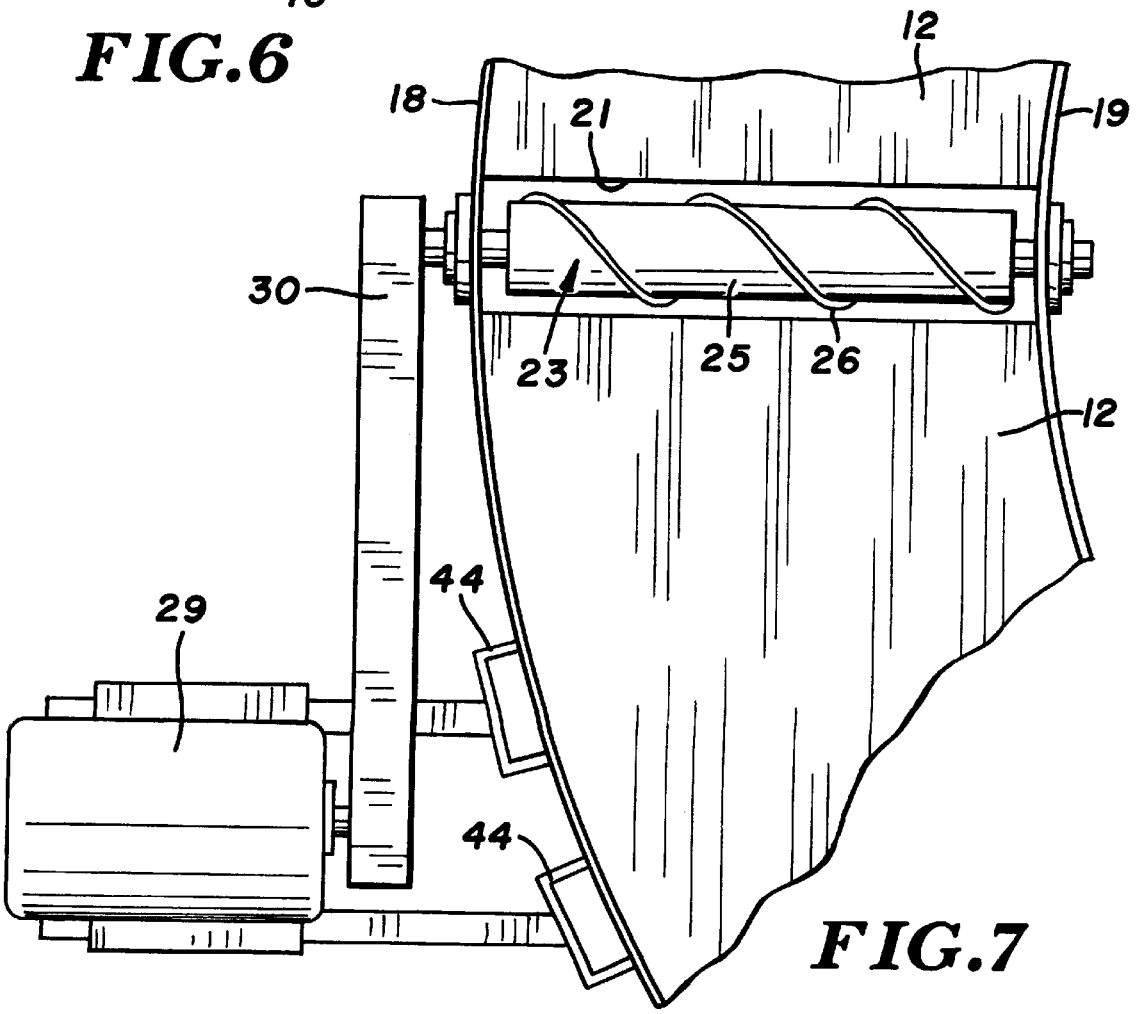
FIG. 7 is a fragmentary plan view on an enlarged scale and illustrating the detail of the cutter drive means including the rotary cutter and its associated motor and belt drive.
Figure 8:
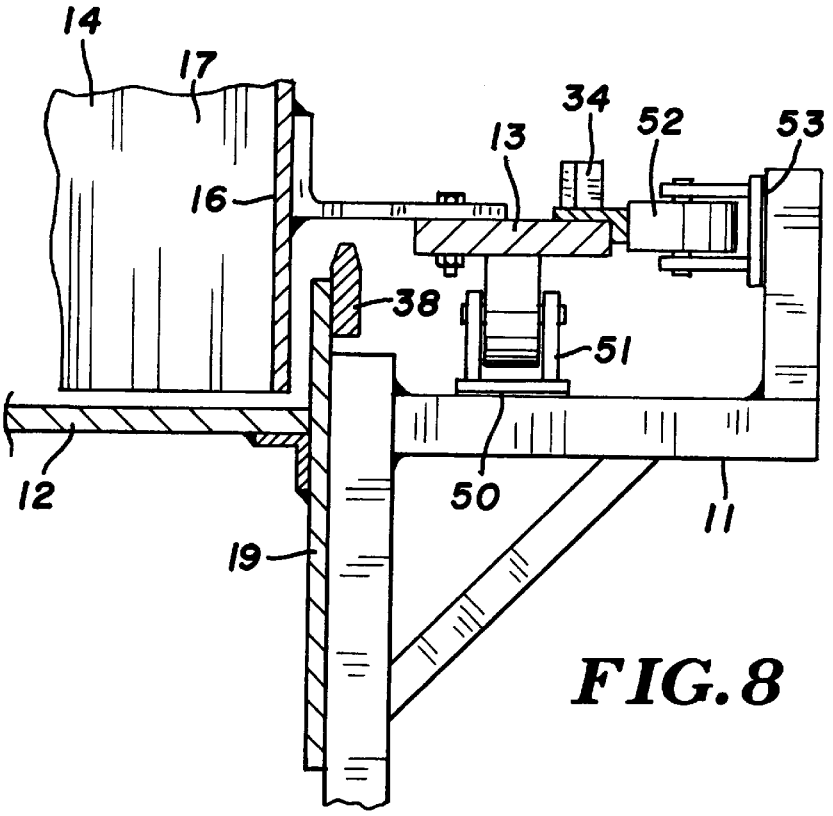
FIG. 8 is a vertical sectional view taken along the line and in the direction of the arrows 8—8 of FIG. 1.
Figure 9:
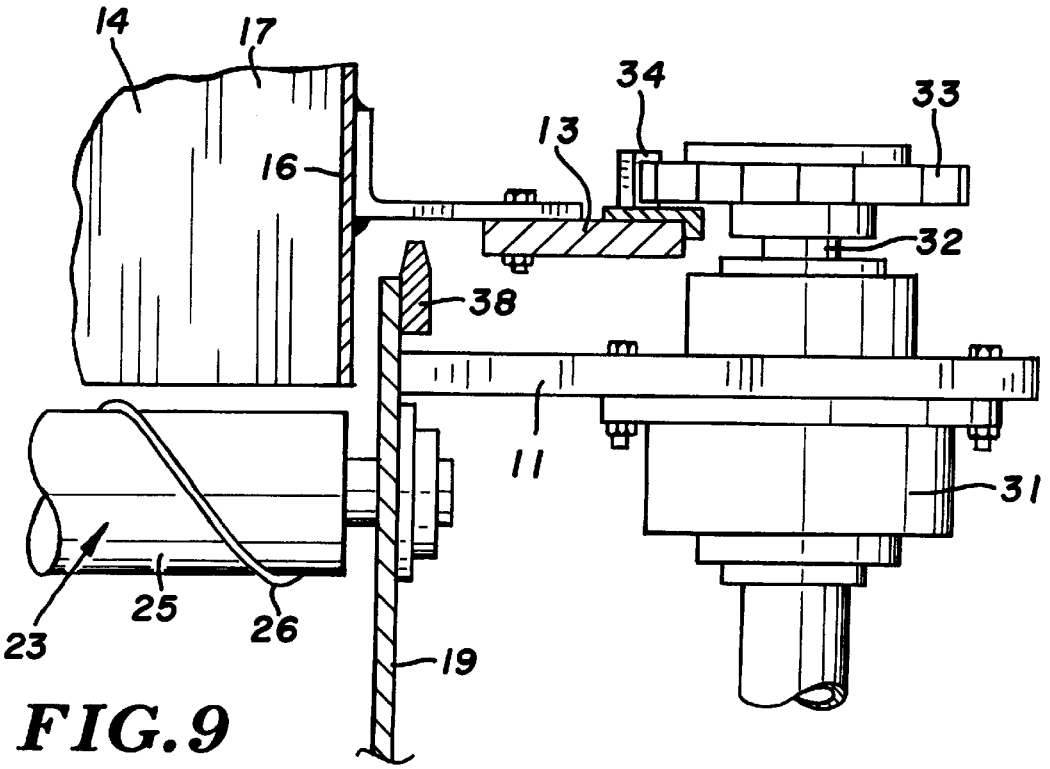
FIG. 9 is a fragmentary detail view on an enlarged scale showing the arrangement of the drive motor and ring gear for propelling the carriage ring about the carriage bed and frame means.

With respect to the carriage bed means 12, and with attention directed to FIG. 5, carriage bed 12 includes an annular base ring 18 with inner and outer walls as at 19 and 20 respectively. Carriage bed means 12 is provided with a plurality of radial slots or gaps as at 21 (FIGS. 6 and 7), with the slots 21 being arranged in generally equally arcuately spaced relationship in annular base ring 18. As is indicated in FIG. 5, annular base ring 18 is secured to inner and outer walls 19 and 20 by means of welded in place angle members, as illustrated in FIG. 6. A rotary cutter shown generally at 23 is positioned in operative relationship within each of the radial slots 21—21. As indicated in the drawings, each of the cutters 23—23 is mounted in operative relationship within each of the radially extending slots 21—21.

With respect to the rotary cutter means, each rotary cutter comprises a right regular cylinder as at 25, and upon which is secured a helically arranged cutter head or blade 26. In other words, the rotary cutters consist of wood planers with helically arranged cutter heads.

Also, as is indicated in the drawings, rotary cutters 23—23 are journaled for rotation within inner and outer walls 19 and 20, and are coupled to a motor and drive belt assembly 29 and 30 for providing the rotational drive for the rotary cutters.

Drive means are also provided for the annular carriage support ring 13. In this connection, drive motor 31 is provided with drive shaft 32 upon which pinion 33 is secured. The teeth of pinion 33 are in mesh with the teeth of ring gear 34, and hence drive motor 31, when energized, rotates annular carriage support ring 13 about carriage bed 12. Thus, when log segments are introduced into each of the boxes 14—14, drive motor 31 rotates the annular carriage support ring about its axis and thus provides for contact of the surfaces of the wooden logs with the rotary cutters, and specifically with the helically arranged cutter heads secured to the outer periphery of the cylinders comprising the rotary cutters.

In order to achieve versatility in cutting rates, drive motor 31 is preferably hydraulically energized, while motors 29—29 may be either hydraulic or electrical.

Figure 4:
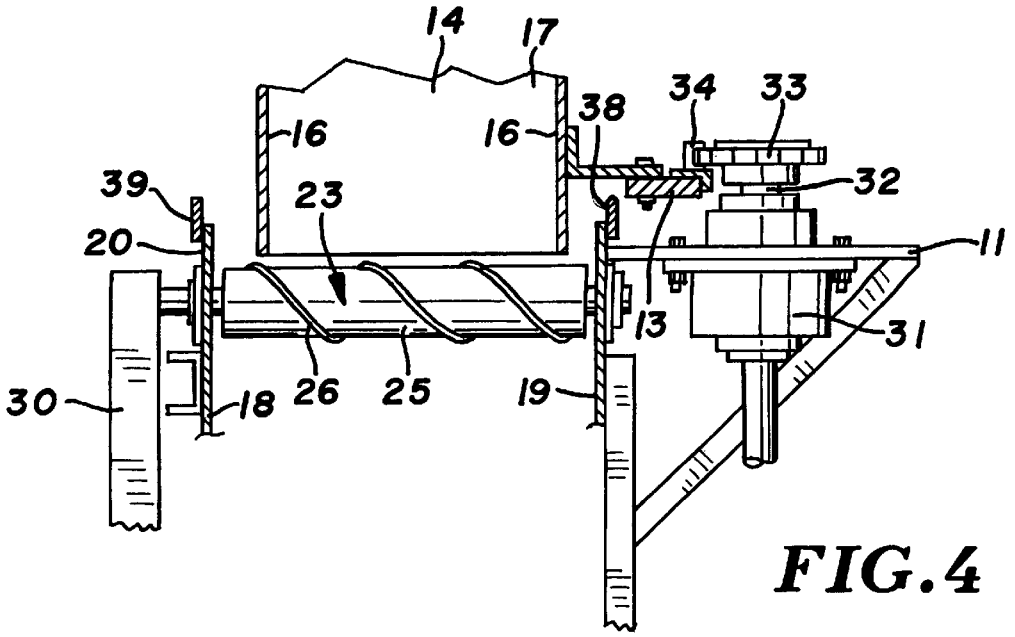
FIG. 4 is a vertical sectional view taken along the line and in the direction of the arrows 4—4 of FIG. 3.

In order to accommodate the relative rotation of the carriage ring means relative to the carriage bed, harden rails as at 38 and 39 are provided together with grooved guide wheels 40—40. An idler wheel or puck is provided at 41—41 for support of annular carriage support ring 13 on carriage bed 12. As is indicated in FIGS. 1, 3 and 4, each of the boxes 14—14 is provided with two pairs of support wheels 40—40 and 41—41, thus providing smooth operation of the rotational motion. Rotary cutters useful in the present invention are commercially available, and one such useful rotary cutter is disclosed in U.S. Pat. No. 4,074,737, Stewart.

As is indicated in FIGS. 3, 4 and 5, motor 31 is mounted on carriage bed 12, while each of the motors 29—29 is mounted upon annular carriage support ring 13. Suitable motor support mounting brackets are illustrated at 44—44. See, for example, FIG. 7.

With attention now being directed to FIG. 6 of the drawings, it will be observed that the helically arranged cutter heads on rotary cutter 23 extend through slot 21. Also, it will be observed that rotary cutters rotate in the direction of arrows 46 as illustrated in FIG. 6. Similar directional arrows 46—46 are shown in FIG. 10. Thus, with the helically arranged cutters, and with the appropriately selected direction of rotation, the direction of shavings and/or chip discharge occurs in the direction of arrow 48, shown in FIG. 10.

With continued attention being directed to FIG. 10, it will be noted that the contact angle between log segments contained within individual boxes 14—14 changes as the log passes over rotary cutter 23. The cutter angles relative to the box are shown in their radially flared configuration in phantom as at 49—49. In addition, the angle of the 45-degree cutter helix is illustrated in FIG. 10.

Figure 2:
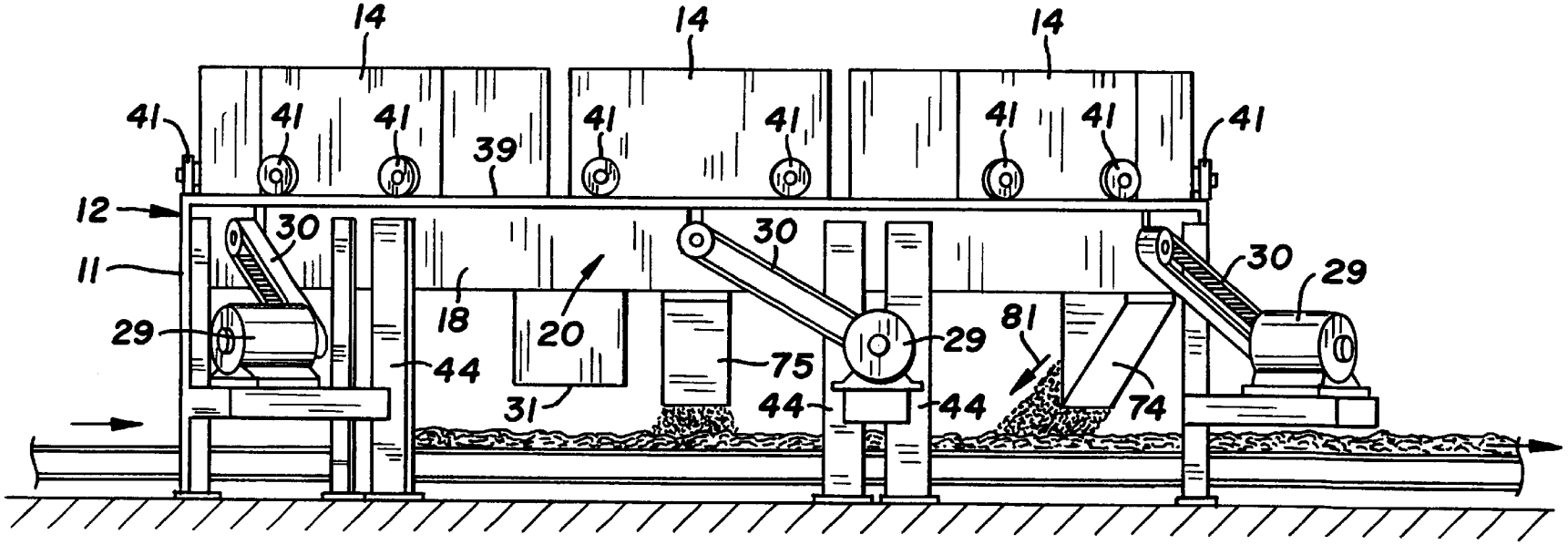
FIG. 2 is a side elevational view of the apparatus of FIG. 1.

With attention being redirected to FIGS. 1, 2, and 10 of the drawings, it will be observed that conveyor system generally designated 70 includes an endless conveyor chip supporting belt 71 driven by suitable drive rolls and idlers (not shown). Such drive rolls and idlers are conventionally utilized, and hence are known to those of skill. In order to deliver the finished shavings onto the surface of the conveyor 71, a plurality of discharge chutes such as illustrated at 72, 73, 74, 75, 76 and 77 are employed. These individual chutes 72–77 are disposed and positioned in such a way that shavings discharged from individual cutter heads will drop into the individual chute, and travel for discharge along belt 71 as a stack of work chips as at 80 (FIG. 2). The path taken by the chips is illustrated by arrows 81—81 (FIG. 10), wherein it is indicated that the chute such as chute 72, for example, delivers its chip load and/or product to the surface of belt 71.

As is indicated, the relationship and configuration of the overall system requires that certain chutes be longer than others, it being understood, therefore, that the length of the individual chute is site-specific.

With respect to the overall operation, individual log segments are introduced into each of the boxes 14—14, and motors 29—29 and 31 are energized. The relative rates of motion are selected such that a preferred rate of rotation for the annular carriage support ring 13 is 2.08 rpm, while individual cutter heads are rotated at a rate of 2500 rpm. Such an arrangement is achieved with motor 31 moving at a rate of 22.5 rpm, and when pinion 33 contains ten teeth while ring gear 34 is provided with 108 teeth. In this connection, therefore, each individual box 14 is associated with a given rotary cutter for a period of 3.5 seconds. This provides for approximately six revolutions per inch of log travel, assuming a 50-inch log is present in box 14. Generally speaking, motion at the rate of between five and eight revolutions per inch of log travel have been found desirable.

In order to accommodate for cutter wear, and in order to provide proper alignment, adjustable shims 50 are provided at mounting pad 51 for ring gear 34. Additionally, guide rollers such as at 52 are provided along with adjustment shims 53 to assist in controlling radial thrust.

It will be appreciated that those skilled in the art may depart from the features of the preferred embodiment provided herein without departing from the spirit and scope of the present invention.

What is claimed is:

1. Apparatus for shaving wooden log surfaces for preparation of wood shavings for animal litter and comprising, in combination, frame means for supporting a carriage bed and carriage ring means respectively, said apparatus being characterized in that:

(a) said carriage means being mounted on said frame means and comprising an annular base ring with inner and outer walls and having a plurality of radial slots formed therein and arranged in generally equally arcuately spaced relationship, one to another, and with a rotary cutter means being mounted in operative relationship with each of said radial slots;

(b) said carriage ring means including a generally annular carriage support ring having a plurality of generally equally arcuately spaced apart log-receiving boxes formed thereon, and with said carriage ring means being adapted for rotation about a central axis normal to the surface of said ring, and with said log-receiving boxes having side and end walls with an open top and an open bottom;

(c) said rotary cutter means including a cylindrical body with helically mound cutter blades secured to the outer surface thereof, and with said cylindrical body being journaled for axial rotation along a cylinder axis disposed in spaced parallel relationship from the upper surface of said carriage bed means;

(d) first and second drive means, said first drive means being adapted to rotate said carriage ring means about said central axis, and with said second drive means being adapted to rotate each of said rotary cutter means about its cylindrical axis;

(e) each of said log-receiving boxes on said carriage ring means being adapted to carry a log along a circular path created upon rotation of said carriage support ring, and with the surface of said wooden log being in contact with the helical cutter heads of each of said rotary cutters for the creation of wooden shavings.

2. The apparatus as defined in claim 1 being particularly characterized in that said carriage ring means is supported upon concentric rails secured to the walls of said carriage bed means.

3. The apparatus as defined in claim 1 being particularly characterized in that means are provided for adjusting the height of each of said rotary cutter means.

4. The apparatus as defined in claim 1 being particularly characterized in that said carriage means has a ring gear adjacent its inner periphery in mesh with the pinion of said first drive motor.

5. The apparatus as defined in claim 1 being particularly characterized in that said helically wound cutter blades are positioned at an angle of approximately 45 degrees to the cylinder axis.

6. The apparatus as defined in claim 1 being particularly characterized in that the rotation of said rotary cutter means is selected for discharge of shavings into the inner annular wall of said carriage bed.

7. The apparatus as defined in claim 1 being particularly characterized in that the axis of rotation of said rotary cutter means is positioned radially with respect to the said carriage bed and carriage support ring.

8. The apparatus as defined in claim 1 being particularly characterized in that said animal litter is poultry litter.

* * * * *